United States Patent [19]

Miskinis

[11] Patent Number: 4,478,925

[45] Date of Patent: Oct. 23, 1984

[54] METHOD OF PREPARING CARRIER PARTICLES FOR ELECTROGRAPHIC MAGNETIC BRUSH DRY DEVELOPMENT

[75] Inventor: Edward T. Miskinis, Rochester, N.Y.

[73] Assignee: Eastman Kodak Company, Rochester, N.Y.

[21] Appl. No.: 471,946

[22] Filed: Mar. 3, 1983

[51] Int. Cl.[3] ..... G03G 9/10

[52] U.S. Cl. ..... 430/137; 430/108; 427/47; 427/221

[58] Field of Search ..... 427/47, 127, 221; 430/39, 137, 108

[56] References Cited

U.S. PATENT DOCUMENTS 4,024,295 5/1977 Chase et al. ..... 427/47

4,081,571 3/1978 Nishihama et al. ..... 427/47

*Primary Examiner*—John E. Kittle

*Assistant Examiner*—John L. Goodrow

*Attorney, Agent, or Firm*—Bernard D. Wiese

[57] ABSTRACT

Magnetic carrier particles for electrophotographic developers are coated with a thermoplastic resin by agitating a dry mixture of carrier particles and resin particles in a magnetic field. Thereafter, the mixture is heated to bond the resin to the carrier particles, which then need no further treatment to improve their conductivity prior to use in an electrophotographic developer.

4 Claims, No Drawings

METHOD OF PREPARING CARRIER PARTICLES FOR ELECTROGRAPHIC MAGNETIC BRUSH DRY DEVELOPMENT

BACKGROUND OF THE INVENTION

1. Field of the Invention

This invention relates to electrography and more particularly to a method for preparing carrier particles for use in magnetic brush dry development of electrostatic charge images.

2. The Prior Art

Electrography broadly includes various processes that involve forming and developing electrostatic charge patterns on surfaces, with or without the use of light. One method of dry electrographic development is the magnetic brush method which is widely used in electrographic document copying machines. It is disclosed, for example, in U.S. Pat. No. 3,003,462. The method of the present invention is useful in preparing the carrier particles for two-component developers used in the magnetic brush method. A two-component developer is a mixture of thermoplastic toner particles and of magnetic carrier particles, the latter being partially coated with an insulating resin.

In one useful embodiment, the two-component developer is attracted to a magnetic brush consisting of stationary magnets surrounded by a rotating cylindrical sleeve. By frictional contact with the resin-coated carrier particles the toner particles are triboelectrically charged and cling to the carrier particles, creating bristle-like formations of developer on the magnetic brush sleeve. In developing a charge pattern the brush is brought close to the charged surface. The oppositely charged toner particles are drawn away from the carrier particles on the magnetic brush by the more strongly charged electrostatic charge pattern, thus developing and making visible the charge pattern.

Although uncoated iron particles can be used as carriers in magnetic brush developers and although the high conductivity of uncoated iron particles is desirable because a conductive magnetic brush serves as a development electrode and improves the development of large solid areas in the image, nevertheless resin-coated carrier particles have often been preferred. One reason for resin-coating the carrier particles has been to improve the triboelectric charging of the toner particles. When a resin-coated carrier is used, the toner powder acquires a high, net electrical charge because of the frictional contact of the toner particles and the resin coating. This high net charge reduces the amount of toner throw-off, i.e., the loss of toner from the developer mix as it is agitated in the magnetic brush apparatus.

U.S. Pat. No. 3,795,617 describes the use of a vinylidene chloride copolymer as the resin coating for magnetic carrier particles. The coated particles described in the patent and the method of preparing them are quite useful. A problem has been, however, that when the carrier particles are coated with resin in the manner described in the patent, the coating insulates the iron particles so much that the conductivity of the particles is low. This causes fringing development and the solid area development suffers. Usually, only after a long break-in period of use in a copier developing station does the coating wear off sufficiently to improve the conductivity of the carrier and the solid area development.

SUMMARY OF THE INVENTION

The invention provides an improvement in the preparation of resin-coated magnetic carrier particles wherein, by a treatment of short duration prior to fusing the resin to the carrier particles, the break-in period, for the resin-coated carrier particles, which in the past has been necessary, is eliminated or shortened.

The method of the invention comprises agitating a dry mixture of magnetic carrier particles and smaller thermoplastic resin particles in the presence of a magnetic field, and thereafter heating the mixture to a temperature and for a time sufficient to bond the thermoplastic resin to the carrier particles. In one embodiment of the method of the invention the mixture of carrier particles and resin particles is agitated in the absence of a magnetic field before it is agitated in the presence of the magnetic field.

Carrier particles prepared by the method of the invention have valuable properties. First, their triboelectric charging properties are excellent. That is, when agitated with thermoplastic toner particles they can create a much higher net charge on the toner particles than carrier particles that are not resin-coated. Next, in contrast to carrier particles that are resin coated in the conventional manner, they have excellent conductivity and require no further treatment or break-in period to improve their conductivity and solid area development capability.

Although I do not wish to be bound by theoretical explanations of the improvement in development results obtained with carriers prepared by the method of the present invention, a possible explanation is that the mixing of the carrier particles with resin particles while in a magnetic field, and before the resin is bonded to the metal, keeps the electrical contact points of the metal particles free of resin and provides metal-to-metal contact. When the resin particles later are thermally bonded to the metal particles, the resin coating is discontinuous and does not block the conductivity of the metal particles. In contrast, when the particles of resin and iron or other magnetic metal are mixed in the absence of a magnetic field in the conventional manner, some triboelectric charging of the polymer particles with the metal particles occurs. Since the metal particles are irregular in shape, the static electric field is highest at the points of the metal particles. This attracts resin particles to the points. Consequently, the coating of insulating resin is thick at the points which otherwise would provide electrical contact of the metal particles.

DETAILED DESCRIPTION

The electrographic developer carriers which are made by the method of this invention can be of any magnetic metal such as iron, cobalt, nickel and alloys and mixtures of such metals. Especially useful are the various forms of iron powder such as porous iron particles having oxidized surfaces, and iron particles prepared by acid washing or by acid washing and nickel cladding as described in U.S. Pat. Nos. 3,632,512 and 3,767,477. Also, especially suitable as carrier particles are the passivated magnetic stainless steel particles disclosed in U.S. Pat. No. 4,310,611. Included within the meaning of ferromagnetic carrier particles which can be treated by the method of the invention are particles of non-metallic substances which have a shell or surface of ferromagnetic metal, e.g., as disclosed in U.S. Pat. No. 2,880,696.

The resin with which the carrier particles are coated in the method of the invention can be any of a large class of thermoplastic polymeric resins. Especially desirable are fluorocarbon polymers such as poly(vinylidene fluoride) and poly(vinylidene fluoride-co-tetrafluoroethylene). Also, useful are the copolymers of vinylidene chloride with acrylic monomers which are disclosed in U.S. Pat. No. 3,795,617. Other examples include cellulose esters such as cellulose acetate and cellulose acetate butyrate, polyesters such as polyethylene terephthalate and poly(1,4-butanediol terephthalate), polyamides such as nylon and polycarbonates. Still other examples include the thermosetting resins and light-hardening resins described in U.S. Pat. No. 3,632,512; the alkali-soluble carboxylated polymers of U.S. Pat. No. Re. 27,912 (Reissue of U.S. Pat. No. 3,547,822); and the ionic copolymers of U.S. Pat. Nos. 3,795,618 and 3,898,170.

The metallic carrier particles used in two-component developers normally are of larger size than the toner particles. Although irregular in shape, they have for example an average diameter from 10 to 1000 microns and preferably from 20 to 500 microns. To obtain particles of the desired particle size range, a convenient way is to screen a mass of particles with standard screens. Particles that pass through a 35 mesh screen and are retained on a 325 mesh screen (U.S. Sieve Series) are especially suitable.

In coating the metallic carrier particles with resin by the method of the invention the carrier particles are mixed with finely-divided powdered resin. The particle size of the powdered resin can vary considerably but should be smaller than the particle size of the carrier particles. The resin particles can range in average diameter from 0.01 to 100 microns although a particle size from 0.05 to 30 microns is preferred.

In coating the carrier particles with resin in accordance with the invention the carrier particles preferably are first dry-mixed with a small amount of powdered resin in the absence of a magnetic field. The word "dry" in the terms "dry-mixed" and "dry mixture" means that the resin powder is not molten or tacky. It should be at a temperature low enough that it will not bond to the metal particles during the dry-mixing step, i.e., a temperature below the glass transition (Tg) for an amorphous polymer and below the melting point for a crystalline polymer.

The amount of resin powder relative to the amount of carrier particles is from 0.05 to 1.5 weight percent. By using such a small amount of resin it is possible to form a discontinuous resin coating or a very thin resin coating on the metal particles and retain good conductivity in accordance with the invention.

To dry-mix the carrier particles and resin particles, they preferably are tumbled together in a rotating vessel. This dry mixing should continue preferably for several minutes, e.g., for 5 to 30 minutes. Other methods of agitation of the particles are also suitable, e.g., mixing in a fluidized bed with an inert gas stream, or mixing by a mechanical stirrer.

After the initial dry-mixing, the mixture of carrier particles and resin powder is placed in a magnetic field and the particles are again agitated, e.g., for 5 to 30 minutes, at a temperature below the glass transition temperature of the resin while in the magnetic field.

A preferred means for agitating the particles in a magnetic field is a copying machine magnetic brush apparatus. Apparatus of this kind comprises a housing or container in which are mounted one or more cylindrical roller members which rotate coaxially about a set of stationary magnets arranged within the roller member, the latter being referred to also as a shell or sleeve. A supply of developer, i.e., a mixture of carrier and toner particles, is placed within the housing and is attracted magnetically to the surface of the rotating roller or rollers. Agitation of the mixture of carrier particles and toner particles occurs as the rollers rotate about the magnets within the housing. The agitation can be assisted by additional means within the housing such as a rotating paddle or auger. Examples of magnetic brush apparatus of this kind which can be used in the method of the invention are described, for example, in patents to Drexler, U.S. Pat. No. 3,543,720; Swapceinski et al, U.S. Pat. No. 4,173,405; Kayson, U.S. Pat. No. 4,101,211; and Swapceinski, U.S. Pat. No. 4,279,942.

In the method of the invention, the strength of the magnetic field can be of any magnitude over a wide range. For example, when the magnetic field is formed by a magnetic brush apparatus which picks up the metal particles, the strength of the magnets need only be sufficient to hold the ferromagnetic particles on the shell or roller surrounding the magnets. The upper limit is governed only by the practical limitations on the size of the magnets. Thus, a field strength from 100 to 2,000 gauss is most suitable, with 300 to 600 gauss being preferred.

Although the initial dry-mixing in the absence of a magnetic field as described is desirable for achieving good mixing of the carrier and resin particles, it can be eliminated if adequate agitating and mixing of the particles is achieved when the carrier and resin particles are dry-mixed in the magnetic field. In that event the mixture of carrier particles and resin powder without prior mixing is placed directly in the magnetic field, and dry-mixed in the same manner as described above.

After dry mixing the carrier particles and resin powder in a magnetic field, the resin is bonded to the carrier particles, for example, by heating the mixture in an oven at a temperature and for a time sufficient to achieve bonding.

The following examples compare the method of the invention with another method of forming a resin coating on electrographic carrier particles.

EXAMPLE 1

The carrier was a nitric acid-washed powdered stainless steel of AISI (American Iron and Steel Institute) type 410L. It contained iron as the major constituent and, by weight, 0.005% Al, 13.5% Cr, 0.025% Cu, <0.0015% Mg, 0.07% Mn, 0.006% Mo, 0.04% Ni, 1.0% Si, 0.025% Ag and <0.005% V. Average particle size of the carrier was in the range from 100 to 200 microns. The powdered resin was a fluorocarbon polymer having a melting point of 160° C. (Kynar 301 poly(vinylidene fluoride), sold by Pennwalt Corp.) Its particle size was in the range from 0.05 to 0.80 microns and the amount of resin was 0.15 weight percent based on the amount of metal carrier. The mixture of carrier particles and resin powder was first tumbled at room temperature in a rotating glass jar for 15 minutes to achieve thorough dry-mixing. Then the mixture was mixed for 15 minutes more at room temperature in a magnetic brush developing station of the type employed in a commercial plain paper office copying machine.

The field strength of the magnetic brush was 450 gauss. After this treatment the resin was bonded to the carrier particles in a curing step in which the mixture was heated in an oven at 230° C. for 240 minutes.

EXAMPLE 2 (Comparison)

A mixture of carrier particles and fluorocarbon resin powder as described in Example 1 was tumbled for two 15 minute periods at room temperature in a glass jar in the absence of a magnetic field and then cured as in Example 1.

EXAMPLE 3 (Comparison)

Another developer batch was made from the carrier and resin powder used in Examples 1 and 2 was tumbled for one 15 minute period in a rotating jar in the absence of the magnetic field. The mixture was then cured as in the previous examples.

The carriers prepared in Examples 1, 2 and 3 were tested to measure their breakdown voltage as described in U.S. Pat. No. 4,076,857. The results of a series of measurements were:

| | Breakdown Voltage (volts) | |
|---|---|---|
| Example 1: | | |
| | 14.8 | Mean = 15.0 |
| | 15.4 | |
| | 15.0 | |
| | 15.0 | |
| | 14.7 | |
| Example 2: | | |
| | 32.5 | Mean = 26.7 |
| | 24.9 | |
| | 26.7 | |
| | 26.2 | |
| | 23.4 | |
| Example 3: | | |
| | 34.7 | Mean = 27.9 |
| | 28.8 | |
| | 25.4 | |
| | 26.8 | |
| | 23.9 | |

The examples demonstrate that the method of the invention (Example 1) produces a carrier having a markedly lower breakdown voltage than the carriers made by other procedures. As a consequence, a developer formed with this carrier achieves good solid area development of electrographic images without requiring a lengthy break-in period.

EXAMPLES 4 (Comparison) and 5

Tests similar to those of Examples 1, 2 and 3 have been made with an oxidized iron powder as the carrier and with the same type of fluorocarbon polymer as previously. A mixture of the iron powder and fluorocarbon resin powder was roll milled at room temperature for 15 minutes and then divided into two portions. The first portion (Ex. 4) was roll milled for another 15 minutes in the absence of a magnetic field. The other (Example 5) was mixed in a magnetic brush apparatus for 15 minutes. After this each mixture sample was cured in an oven at 187° C. for 4 hours. After cooling to room temperature, the breakdown voltages of the two samples were measured as described in U.S. Pat. No. 4,076,857. The breakdown voltage of the Example 4 sample (comparison example) was 156.0 volts, while that of Example 5 (the invention example) was 120.4 volts. These results indicate that, as with the stainless steel carrier of Examples 1, 2 and 3, the mixing of the oxidized iron carrier with polymer in a magnetic field before curing will aid in reducing the breakdown voltage of the carrier.

EXAMPLE 6

To determine whether agitation in a magnetic field causes removal of fused fluorocarbon resin from iron carrier particles, measurements of fluorine content were made by electron scan chemical analysis (ESCA) for resin coated iron particles which, after curing, were agitated at room temperature for different lengths of time in a magnetic brush apparatus. Results of such ESCA measurements for a mixture agitated in the magnetic brush for 0, 5, 10, 15 and 20 minutes show that the fluorine signal drops from a value of 1.5 with no agitation in the magnetic brush (0 minutes) to 1.0 after 15 minutes of mixing and remains at that level after 20 minutes of mixing. This indicates that the cured fluorocarbon resin on the metal particles is being partially removed during agitation in the magnetic field. The stabilization of fluorine signal after 15 minutes as observed in this example correlates well with electrical measurements in which, after 15 minutes of magnetic brush mixing, a carrier reached its minimum in breakdown voltage.

EXAMPLE 7

Samples of another batch of oxidized iron carrier particles mixed with the same fluorocarbon resin powder as in the other examples were mixed at room temperature in a single-roller magnetic brush apparatus for up to 20 minutes. After fusing the resin to the iron particles, as previously described, breakdown voltage measurements were made of samples which had been mixed for 0,5,10, 15 and 20 minutes in the magnetic brush. The breakdown voltage of the carrier samples dropped from about 62 volts for zero minutes of magnetic brush mixing to about 43 volts for 5 minutes and about 30 volts for 20 minutes. This demonstrates further the benefits of the method of the invention for another kind of ferromagnetic carrier.

The invention has been described in detail with particular reference to preferred embodiments thereof, but it will be understood that variations and modifications can be effected within the spirit and scope of the invention.

We claim:

1. A method of preparation of resin-coated ferromagnetic carrier particles for electrographic development which comprises agitating a dry mixture of ferromagnetic carrier particles and resin particles in the presence of a magnetic field and thereafter heating the mixture to a temperature and for a time sufficient to form a discontinuous bonded coating of the resin on the ferromagnetic particles.

2. A method according to claim 1 wherein the ferromagnetic particles are iron or steel particles having an average diameter 40 to 500 microns, the resin is a thermoplastic fluorocarbon polymer and the resin particles are smaller than the carrier particles and have a particle size from 1 to 30 microns.

3. A method according to claim 2, wherein the magnetic field is formed by a magnetic brush and has a strength of at least 300 gauss.

4. A method according to claim 3, wherein the carrier particles and resin particles are first dry-mixed with thorough agitation in the absence of a magnetic field before being dry-mixed in the presence of a magnetic field and thereafter the dry-mixed product is heated to bond the resin to the carrier particles.

* * * * *